US012252331B2

(12) United States Patent
Bodet et al.

(10) Patent No.: US 12,252,331 B2
(45) Date of Patent: Mar. 18, 2025

(54) VALVE FOR PRESSURIZED CONTAINER

(71) Applicant: LINDAL FRANCE SAS, Val de Briey (FR)

(72) Inventors: Hervé Bodet, Verdun (FR); Eric Gaillard, Dieue-sur-Meuse (FR)

(73) Assignee: LINDAL FRANCE SAS, Val de Briey (FR)

( * ) Notice: Subject to any disclaimer, the term of this patent is extended or adjusted under 35 U.S.C. 154(b) by 0 days.

(21) Appl. No.: 17/629,125

(22) PCT Filed: Jul. 13, 2020

(86) PCT No.: PCT/EP2020/069713
§ 371 (c)(1),
(2) Date: Jan. 21, 2022

(87) PCT Pub. No.: WO2021/013599
PCT Pub. Date: Jan. 28, 2021

(65) Prior Publication Data

US 2022/0274770 A1 Sep. 1, 2022

(30) Foreign Application Priority Data

Jul. 24, 2019 (FR) ..... 1908421

(51) Int. Cl.
*B65D 83/48* (2006.01)
*B65D 83/38* (2006.01)
*B65D 83/62* (2006.01)

(52) U.S. Cl.
CPC ..... *B65D 83/48* (2013.01); *B65D 83/38* (2013.01); *B65D 83/62* (2013.01)

(58) Field of Classification Search
CPC ..... B65D 83/38; B65D 83/48; B65D 83/62
See application file for complete search history.

(56) References Cited

U.S. PATENT DOCUMENTS 2,709,111 A 5/1955 Green
2,731,298 A * 1/1956 Green ..... B65D 83/46 141/20

(Continued)

FOREIGN PATENT DOCUMENTS

AR 029850 A1 7/2003
CA 1337812 C 12/1995

(Continued)

OTHER PUBLICATIONS

Office Action dated Oct. 27, 2023 in co-pending U.S. Appl. No. 17/629,142; with PTO892, without returned SB08 (total 11 pages).

(Continued)

*Primary Examiner* — Paul R Durand
*Assistant Examiner* — Randall A Gruby
(74) *Attorney, Agent, or Firm* — Seckel IP, PLLC

(57) ABSTRACT

The valve (1) for pressurized container,
includes a valve body (10) in which are
placed a spring (20), a valve member (30), and a cup (50) having an outer face (53) and an inner face (54) and being provided with a central opening (52) through which a product outlet rod (31) can
pass, the valve body (10) being fixed to the inner face (54) of the
cup (50), the valve seal (40) being pressed against the cup while surrounding the central opening (52), and the valve body (10) being fixed to the inner face of the cup (50) by welding.

13 Claims, 3 Drawing Sheets

(56) References Cited

U.S. PATENT DOCUMENTS 2,775,483 A * 12/1956 Treharne, Jr. ..... B65D 83/425 251/210
2,854,176 A 9/1958 Edwards
2,965,271 A 12/1960 Soffer et al.
3,169,677 A * 2/1965 Focht ..... B65D 83/54 239/350
3,180,535 A * 4/1965 Ward ..... B65D 83/525 222/335
3,424,353 A 1/1969 Meador et al.
3,512,685 A * 5/1970 Ewald ..... B65D 83/38 222/399
3,593,886 A 7/1971 Morane
3,593,887 A 7/1971 Morane
3,598,292 A 8/1971 Kiliany
3,627,179 A 12/1971 Scheindel
3,674,180 A 7/1972 Morane
3,702,669 A * 11/1972 Ewald ..... B65D 83/60 222/402.16
3,738,542 A * 6/1973 Ruscitti ..... B65D 83/54 222/402.2
3,741,446 A 6/1973 Marand
3,819,090 A 6/1974 Birrell
3,830,412 A * 8/1974 Green ..... B65D 83/44 222/402.24
3,893,653 A * 7/1975 Kolanus ..... B65D 83/48 251/353
3,915,390 A * 10/1975 Green ..... B65D 83/48 222/394
3,958,727 A * 5/1976 Steiman ..... B65D 83/48 222/402.24
3,982,668 A 9/1976 Riccio
4,441,635 A 4/1984 Beard
4,463,784 A * 8/1984 Butcher ..... B65D 83/425 141/20
4,792,067 A * 12/1988 Greenebaum, II ..... B65D 83/38 222/402.1
4,813,576 A * 3/1989 Greenebaum, II ..... B65D 83/38 222/394
4,919,312 A 4/1990 Beard et al.
4,958,757 A * 9/1990 Greenebaume, II ... B65D 83/38 222/402.1
5,016,785 A * 5/1991 Greenebaum, II ..... B65D 83/38 222/402.1
5,082,652 A * 1/1992 Mayfield ..... A61K 8/046 424/47
5,215,209 A * 6/1993 Radtke ..... B65D 83/38 222/402.1
5,406,689 A * 4/1995 Radtke ..... B65D 83/38 413/8
5,769,283 A * 6/1998 Owada ..... B65D 83/54 222/402.2
5,881,929 A * 3/1999 Coerver, Jr. ..... B65D 83/425 222/394
5,906,046 A * 5/1999 Abplanalp ..... B65D 83/46 29/890.127
5,915,598 A * 6/1999 Yazawa ..... B65D 83/44 222/402.1
5,957,342 A * 9/1999 Gallien ..... B65D 83/38 222/402.22
6,070,770 A * 6/2000 Tada ..... B65D 83/44 222/402.1
6,112,950 A * 9/2000 Di Giovanni ..... B65D 83/54 222/402.1
6,152,190 A * 11/2000 Smith ..... B65D 83/425 222/402.1
6,161,599 A * 12/2000 Smith ..... B65D 83/425 222/402.1
6,244,475 B1 6/2001 Walz et al.
6,296,156 B1 10/2001 Lasserre et al.
6,357,633 B1 * 3/2002 Zimmerhackel ..... B65D 83/48 222/402.1
6,454,140 B1 * 9/2002 Jinks ..... B65D 83/54 222/402.2
6,527,149 B1 3/2003 Garcia et al.
6,824,079 B2 * 11/2004 Kendrick ..... B65D 83/752 239/354
6,832,704 B2 * 12/2004 Smith ..... B65D 83/425 222/402.1
7,086,571 B2 * 8/2006 Warby ..... B65D 83/54 222/402.1
7,124,788 B2 10/2006 Pericard
7,798,366 B2 9/2010 Hoshino
8,292,121 B2 * 10/2012 Davideit ..... B65D 83/425 222/105
8,678,248 B2 * 3/2014 Davideit ..... B65D 83/54 222/542
9,132,955 B2 9/2015 Smith et al.
9,192,948 B2 11/2015 Bodet et al.
9,254,954 B2 2/2016 Davideit et al.
9,554,982 B2 * 1/2017 Swaile ..... A61K 8/26
9,573,750 B2 * 2/2017 Seling ..... B65D 83/38
9,624,021 B2 4/2017 Bodet et al.
9,694,967 B2 * 7/2017 Salameh ..... B65D 83/40
10,246,251 B2 4/2019 Bodet et al.
10,399,767 B2 9/2019 Plaschkes et al.
10,532,881 B2 1/2020 Bodet et al.
10,562,697 B2 * 2/2020 Ramsey ..... B65D 83/38
10,661,291 B2 5/2020 Schmid
10,793,343 B1 10/2020 Alonso et al.
11,273,972 B2 3/2022 Bodet et al.
11,299,338 B2 * 4/2022 Jasper ..... B29C 65/08
11,332,301 B2 5/2022 Borel et al.
11,845,605 B2 * 12/2023 Jasper ..... B29C 66/5344
11,866,248 B2 1/2024 Baker et al.
11,884,477 B2 * 1/2024 Jasper ..... B65D 83/48
2002/0190085 A1 * 12/2002 Stanford ..... B65D 83/54 222/402.1
2003/0024953 A1 * 2/2003 Peter Lilienthal ... B65D 83/682 222/402.1
2003/0089739 A1 * 5/2003 O'Connor ..... B65D 83/682 222/402.1
2004/0226964 A1 11/2004 Bourque et al.
2005/0121476 A1 * 6/2005 Pauls ..... B65D 83/48 222/402.24
2009/0001103 A1 1/2009 Wanbaugh
2009/0078903 A1 3/2009 Rideg
2010/0044400 A1 * 2/2010 Laidler ..... B65D 83/44 222/402.1
2010/0051651 A1 * 3/2010 Allsop ..... B65D 83/425 222/402.2
2010/0300916 A1 12/2010 Alvares et al.
2011/0127300 A1 6/2011 Ghavami-Nasr et al.
2013/0092710 A1 4/2013 Bodet et al.
2015/0034682 A1 2/2015 Kerstin et al.
2015/0108387 A1 4/2015 Smith
2015/0197392 A1 7/2015 Walter et al.
2015/0375922 A1 12/2015 Smith et al.
2016/0009482 A1 1/2016 Martz et al.
2016/0152404 A1 6/2016 Hawthorne et al.
2017/0008692 A1 1/2017 Davideit et al.
2018/0022536 A1 * 1/2018 Borel ..... B65D 83/42 141/3
2018/0127195 A1 5/2018 Ramsey
2018/0134481 A1 5/2018 Bodet et al.
2018/0222613 A1 8/2018 Geier et al.
2018/0222647 A1 * 8/2018 Geier ..... B65D 53/02
2019/0161268 A1 5/2019 Geier
2020/0087053 A1 3/2020 Geier
2021/0002064 A1 1/2021 Tsubouchi et al.
2021/0107727 A1 4/2021 Borel et al.
2022/0274770 A1 * 9/2022 Bodet ..... B65D 83/48
2022/0289468 A1 * 9/2022 Bodet ..... B65D 83/38
2022/0297925 A1 * 9/2022 Bodet ..... B65D 83/425

FOREIGN PATENT DOCUMENTS

CH 676585 A5 2/1991
DE 3544924 A1 7/1987
EP 0108550 A2 5/1984

(56) References Cited

FOREIGN PATENT DOCUMENTS

| | | | |
|---|---|---|---|
| EP | 0258299 | A1 | 3/1988 |
| EP | 3526138 | B1 | 4/2020 |
| FR | 2441778 | A1 | 6/1980 |
| FR | 2508136 | A1 | 12/1982 |
| FR | 2741048 | A1 | 5/1997 |
| FR | 2971773 | A1 | 8/2012 |
| FR | 3038589 | A1 | 1/2017 |
| GB | 2037378 | B | 10/1982 |
| JP | H11-171270 | A | 6/1999 |
| WO | 8101130 | A1 | 4/1981 |
| WO | 8908062 | A1 | 9/1989 |
| WO | 2007107174 | A1 | 9/2007 |
| WO | 2015158609 | A1 | 10/2015 |
| WO | 2016202754 | A1 | 12/2016 |
| WO | 2017021038 | A1 | 2/2017 |
| WO | 2017021039 | A1 | 2/2017 |
| WO | 2018052973 | A1 | 3/2018 |
| WO | 2018073042 | A1 | 4/2018 |
| WO | 2023131621 | A1 | 7/2023 |

OTHER PUBLICATIONS

Merrian-Webster, definition of "fix", merriam-webster.com/dictionary/fix, visited Oct. 17, 2023 (total 10 pages) (note: Ref.U(page1of3) cited in the Office Action dated Oct. 27, 2023 in co-pending U.S. Appl. No. 17/629,142).

AR Office Action dated Oct. 18, 2023 in counterpart application No. AR 20200102053; with English machine translation (total 38 pages) (note: EP0258299, FR2741048, WO8908062, EP0108550, D1, D2, D3 and D5 cited in the AR Office Action, are not listed in this IDS since they are already of record in this application).

EP Search Report and Written Opinion dated Oct. 27, 2023 in counterpart divisional application No. EP 23195357.3; with English machine translation (total 16 pages) (note: D1-D8 cited in the ESR dated Oct. 27, 2023 are not listed in this IDS since they are already of record in this application).

International Search Report and Written Opinion dated Oct. 21, 2020 in application No. PCT/EP2020/069732 corresponding to co-pending U.S. Appl. No. 17/629,142; w/ English partial translation and partial machine translation (total 15 pages).

European Search Report and Written Opinion dated Apr. 14, 2023 in application No. EP 23152857, divisional of application No. EP20743094, counterpart of co-pending U.S. Appl. No. 17/629,142; with English.machine translation (total 17 pages).

EP Office Action dated Oct. 26, 2023 in counterpart application EP 20740532.9; with English machine translation (total 10 pages).

Office Action dated Mar. 24, 2023 in co-pending U.S. Appl. No. 17/629,142; with PTO892, without returned SB08 (total 15 pages) (Note: Ref. D, U.S. Pat. No. 4,919,312, its counterpart EP0258299, Ref. E, U.S. Pat. No. 4,441,635, and Ref.H, US20160009482, are not isted in this IDS form since they were already listed in the IDS filed Jan. 21, 2022).

International Search Report and Written Opinion dated Oct. 1, 2020 in corresponding application No. PCT/EP2020/069713; w/ English partial translation and partial machine translation (total 14 pages).

Office Action dated Jan. 31, 2024 in co-pending U.S. Appl. No. 17/629,142; with PTO892, without returned SB08 (total 13 pages) (note: U.S. Pat. No. 5,215,209, ref.H cited in the Office Action dated Jan. 31, 2024, is not listed in this IDS since it is already of record in this application).

EP Office Action dated Oct. 2, 2024 in application EP 20743094.3, counterpart of co-pending U.S. Appl. No. 17/629,142; with English machine translation (total 12 pages) (note: US2016009482 and WO8101130, D1 and D4 cited in the EP Office Action, are not listed in this IDS since they are already of record in this application).

* cited by examiner

Fig. 3
Fig. 3a
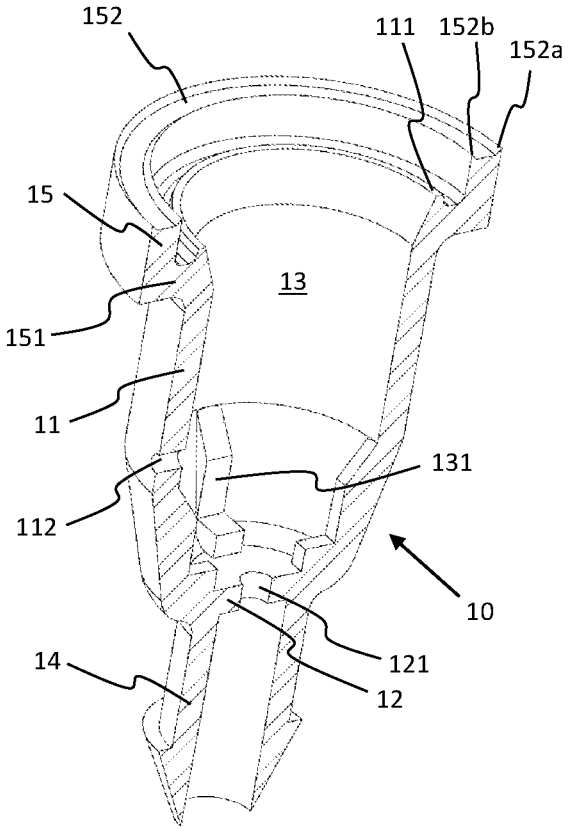
Fig. 3b
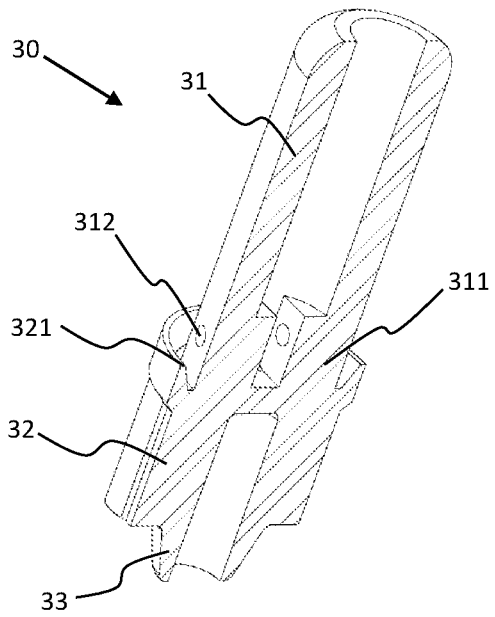
Fig. 4
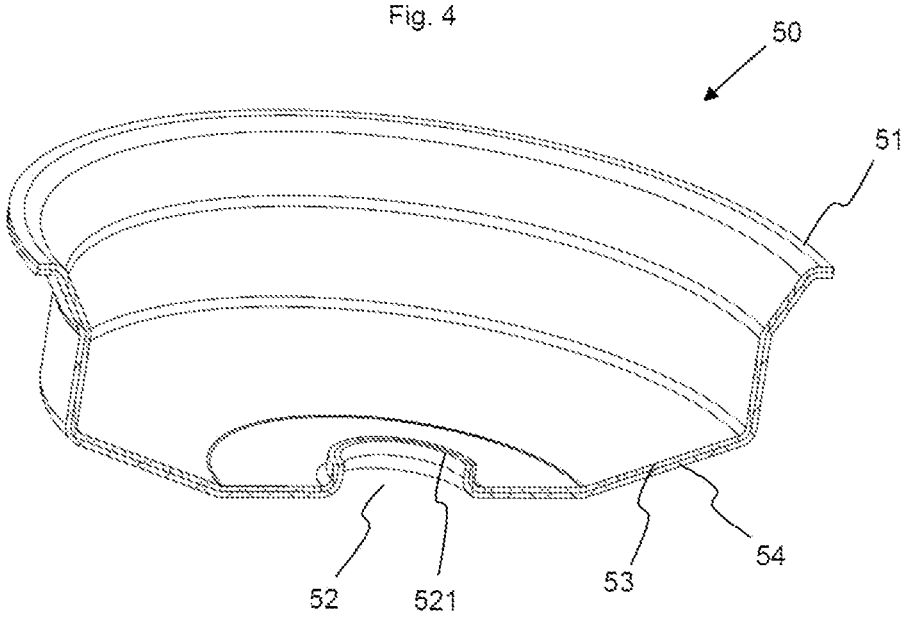

VALVE FOR PRESSURIZED CONTAINER

FIELD OF THE INVENTION

The invention relates to a valve for pressurized container, comprising:

- a valve body in which are placed:
  - a spring,
  - a valve member, and
  - a valve seal, as well as
- a cup having an outer face and an inner face and being provided with a central opening through which a product outlet rod can pass, the valve body being fixed to the inner face of the cup.

BACKGROUND ART

Valves according to the preamble are commonly used for pressurized containers, in particular for aerosol dispensers. A valve body is fixed to a cup, forming an internal chamber in which are located a spring, a seal, and between the two, at least a portion of the valve member. The spring pushes the valve member against the seal so that the valve is closed. To insert the seal, the spring and the valve member, it is essential to have an opening for access before final assembly. Traditionally, the cup is crimped on the top of the valve body, which for this purpose is provided with an annular extra thickness at its top. This method works very well when the cup is metallic. However, the current trend is to eliminate metal parts and replace them with plastic whenever possible, in order to facilitate recycling of aerosol dispensers. Valves are therefore known in which the cup too is made of plastic.

In this case, it is possible to have a single-piece unit constituted by the valve body and the cup, the internal space then being closed by a washer welded from above. Such a valve is known from document WO 2016/202754 A1, for example. The drawback of this solution lies in the fact that, if the weld between the washer and the cup were defective, the washer could come off and be forcefully expelled, at the risk of injuring its user.

In other variants, the valve body is fixed to the cup by snap-fastening. As an example, document FR 2 508 136 A1 can be cited. This requires more complex molds to make, on the one hand, the snap-fastening tabs on the cup or the valve body, and on the other hand, the corresponding recesses on the other part. In addition, the parts must be oversized to take into account the height of the fixation.

SUMMARY OF THE INVENTION

The objective of the invention is to remedy these drawbacks.

This objective is achieved by the fact that the valve seal is pressed against the cup while surrounding the central opening, and by the fact that the valve body is fixed to the inner face of the cup by welding. This solution makes it possible to have parts that are easier to manufacture. In addition, no part can be expelled towards the user in the event of a faulty fixation of the valve body on the cup.

In order to facilitate welding of the valve body to the cup, it is preferable that the inner face of the cup and the valve body are made of plastic material, preferably polypropylene (PP) or another polyolefin. For the assembly to succeed, it is sufficient for the materials chosen for one of the parts to be compatible with that of the other part.

In order for the cup to have greater rigidity, it can be constituted by at least one metallic outer layer, preferably aluminum or tinplate, and by an inner layer in plastic material, preferably polypropylene (PP) or another polyolefin.

The valve body can comprise a tubular body provided with

- at one end, an annular tapered edge, which tapered edge bears sealingly against the valve seal while surrounding the central opening, as well as
- a fixing crown by which the valve body is welded to the cup.

The valve body can be welded to a flat portion of the cup which extends beyond the valve body. The cup can also have a domed shape so that its inner face or its outer face has a generally convex shape. In both cases, the edge of the central opening can be folded upright, in particular folded upright on the side of the outer face. Such a cup that is flat at least at the valve body, or slightly convex, can be chosen, for example, if the cup will contain at least one metallic layer. The upright-folded edge helps to reinforce the cup.

In another variant embodiment, the central opening of the cup is made in a bottom wall of a cylindrical well, the valve seal being placed against the bottom wall of the cylindrical well. The benefit of a well can be to raise the central opening relative to the peripheral edge that serves to fix the valve on the can. It can also make it possible to place reinforcing ribs on the outer face of the cup, in contact with the outer face of the cylindrical well. Reinforcing ribs can be provided on at least one face of the cup, even when the central opening of the cup is not made in a bottom wall.

When the valve body has a tapered edge and the central opening of the cup is located at the bottom of a well, it is preferable that the end of the valve body provided with the tapered edge penetrates in the cylindrical well. Depending on needs, the weld can be made either between the fixing crown introduced into the well and the bottom wall of the well, or between the fixing crown wider than the well and a peripheral section of the cup which surrounds the well. It is also possible to envision welding the side walls of the valve body and of the well to each other.

In another variant of a cup with the central opening placed at the bottom of a well, the valve body can comprise a tubular body provided with a fixing crown by which the valve body is welded to the cup, with the valve body being placed completely outside the well, the weld being made between the fixing crown wider than the well and a peripheral section of the cup which surrounds the well.

The invention also relates to a method of manufacturing a valve according to the invention. This process provides the following steps:

- the spring is placed in the bottom of the valve body;
- the valve seal is mounted on the rod of the valve member;
- the valve member/seal assembly is inserted into the valve body so that the lower end of the valve member bears against the spring;
- the cup is then put in place, by passing the free end of the rod of the valve member through the central opening of the cup when the valve member is of the stem type for a male valve, following which the cup is brought closer to the valve body until the valve body is in contact with the inner face of the cup;
- the cup and the valve body are welded, preferably by ultrasonic welding or by spin welding.

BRIEF DESCRIPTION OF THE DRAWINGS

The invention is described in more detail below with the aid of the figures which show:

FIG. 3: a cross-sectional and perspective view (a) of the valve body of the valve of FIG. 1, and (b) of the stem;

FIG. 4: a cross-sectional and perspective view of the cup of the valve of FIG. 1;

DETAILED DESCRIPTION OF PARTICULAR EMBODIMENTS

Figure 1:
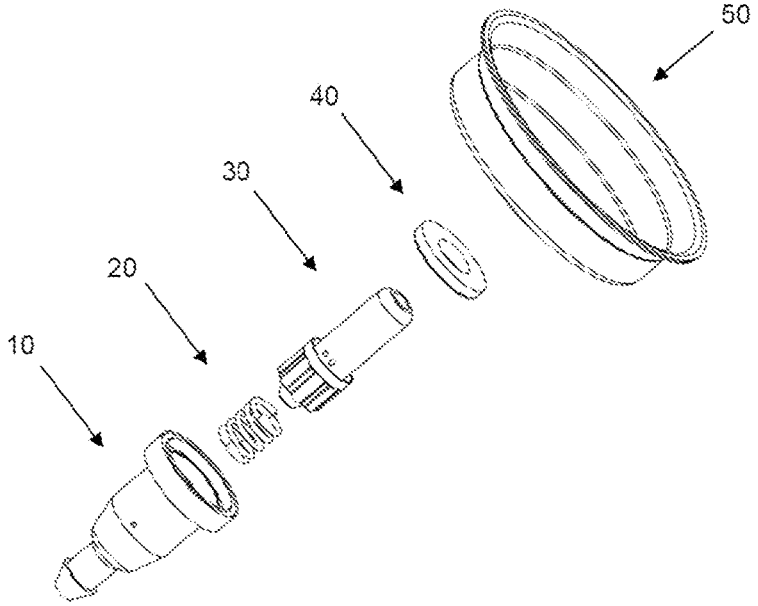
FIG. 1: an exploded cross-sectional view of a valve according to the invention.

The invention relates to a valve (1) for a pressurized container. The valve (1) is constituted mainly by:

- a cup (50) and
- a valve body (10) in which are placed:
  - a spring (20),
  - a valve member, which in this case has the shape of a stem (30), and
- a valve seal (40).

The valve (1) of the invention can be used in all positions. In the figures illustrating this application, the valve is shown with the stem directed upwards. The references "top"/"bottom" or "upper"/"lower" have only a relative value in relation to the representations of the accompanying figures. It is self-evident that the valve can be used in all positions and that what is up in the position shown here will not necessarily be so during use. Further, the valve extends longitudinally with respect to a main axis (A), which is vertical in the representations of the accompanying figures. The terms "radial", "axial" and "transverse" refer to this main axis (A).

As with any valve with cup, the cup (50) forms a separation between the side of the valve intended to be placed inside the can and the other side intended to be outside the can. The terms "inner" and "outer" refer to the elements located on the inner side or on the outer side of the cup. The terms "internal" and "external" refer to a specific component (in particular the valve body) and define what is inside or outside said component, regardless of whether it is a component located on the inner or outer face of the cup.

The example presented here is a male type valve having as valve member a stem (30), of which a portion of the rod protrudes out of the valve. The invention can also be applied to a female type valve having as valve member a valve seat located in the valve body and requiring actuation by an outer rod (generally, that of an actuator) penetrating into the valve.

The valve body (10) is formed mainly by a tubular body (11) partially closed at a first end, called the lower end, by a bottom wall (12) having an inlet opening (121). The tubular body (11) and the bottom wall (12) together define an internal chamber (13). Vertical ribs (131) can be provided in the bottom of the internal chamber, near the bottom wall. These ribs protrude radially from the tubular body towards the center of the internal chamber, forming a receiving space in which a first end of the spring (20) can be received and retained radially. A fixing tenon (14) can be provided on the external face of the bottom wall (12) for fixing, for example, a dip tube or anti-collapsing means. This tenon (14) has a tubular shape and surrounds the inlet opening (121).

At least one opening (112) can be provided in the tubular body (11), which opening forms a passage bringing the external face and the internal face of the tubular body in contact. This opening, which is not required, serves as an additional gas inlet to improve the quality of the spraying.

The second end of the tubular body (11) ends with a tapered edge (111). It is surrounded by a fixing crown (15) which is constituted by a tubular wall connected to the second end of the tubular body by a transverse wall (151). This transverse wall is, for example, parallel to a plane perpendicular to the main axis (A). It can be solid, as in the present example, or crenellated if it is not necessary to ensure sealing between the two faces of this transverse wall. The annular edge surface (upper face) (152) of the fixing crown (15) is preferably provided with at least one extra thickness of material that extends all around the crown and serves as energy director during ultrasonic welding of the valve body on the cup. In the example presented here, there are two rings of extra thickness of material (152*a*, 152*b*).

The cup (50) is constituted by a plate provided with

- a peripheral edge (51) intended for fixing the cup to a can, not shown, and
- a central opening (52) through which passes a product outlet rod.

Figure 2:
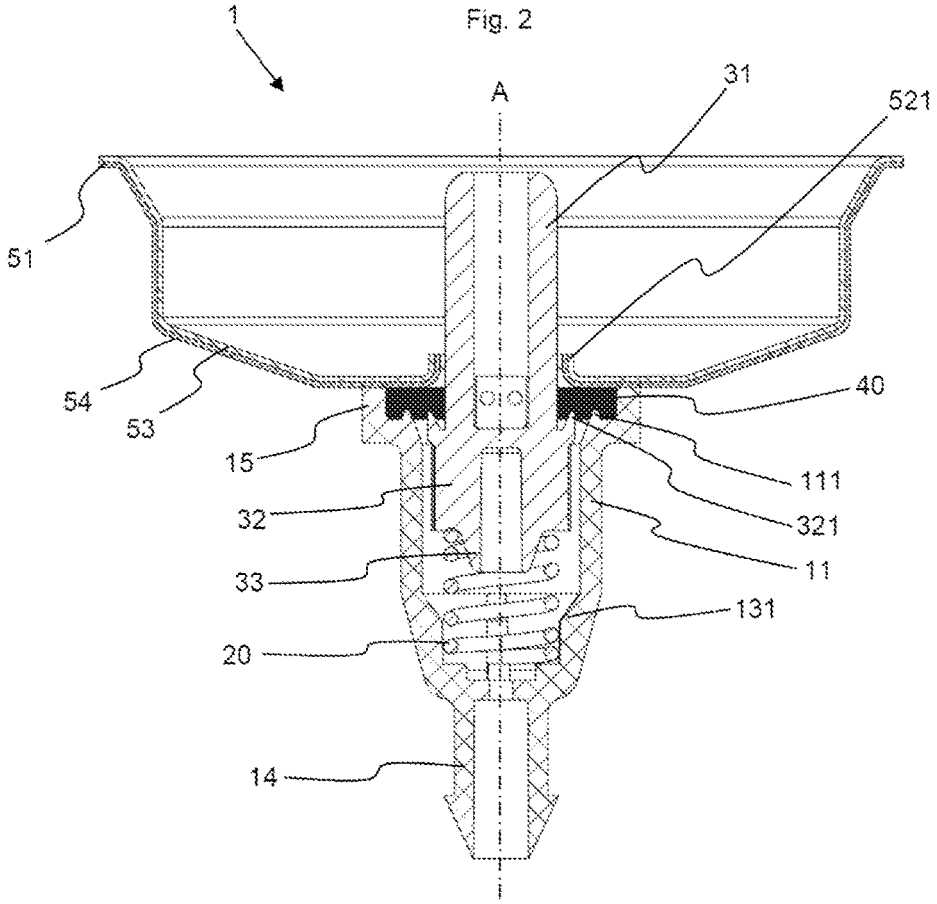
FIG. 2: a cross-sectional view of the valve of FIG. 1.

As illustrated on FIG. 2, the peripheral edge (51) of the cup forms a flat ring.

The rod can be carried by a valve member to be inserted at least partially into the valve body (thus, by a stem) if it is a valve of the male type, or by an actuator intended to actuate the valve if it is a female type valve.

The cup can be made entirely in plastic material. It is also possible that it is constituted, as in the present example, by a metallic outer layer (53) and an inner layer (54) in plastic material. The edge (521) of the central opening (52) can be folded upright, in particular on the side of the outer face.

The stem (30) has a usual shape. It is formed by a cylindrical wall (31) open at its upper end (311) and closed at its lower end, forming an outlet channel for the product. One or more orifices (312) placed at the bottom of the outlet channel pass radially through the cylindrical wall to bring the internal face and the external face of said cylindrical wall (31) in contact. The cylindrical wall (31) constitutes the product outlet rod. This cylindrical wall is continued by a crown (32) of larger diameter having on its external face vertical channels or vertical ribs allowing the product to bypass the crown. The outer envelope of this crown has a diameter slightly smaller than the internal diameter of the tubular body (11) of the valve body so that it can enter into the latter while being guided. On its upper annular face, the crown (32) is provided with a sealing rib (321) to ensure sealing with the valve seal (40). The crown (32) is continued downwards by a guiding tenon (33) intended to cooperate with the second end of the spring (20).

The valve seal (40) is also a classic part. It is an annular seal, the internal diameter of which is chosen to fit tightly and sealingly around the cylindrical wall (31) of the stem. The external diameter is chosen so that the entire tapered edge (111) of the tubular body of the valve body can bear sealingly against the valve seal (40). In the present example, the valve seal takes place in the space delimited, on the one hand, by the internal face of the fixing crown, and on the other hand, by the transverse wall (151).

The spring is caught between the bottom wall (12) of the valve body and the guiding tenon (33) of the stem.

The valve of the invention is assembled as follows. The spring (20) is placed in the bottom of the internal chamber (13) with its first end located between the vertical ribs (131). The valve seal (40) is mounted on the stem (30) so that, on the one hand, it obstructs the orifices (312) of the stem, and on the other hand, it bears sealingly against the sealing rib (321). The stem/seal assembly is inserted into the valve body by the guiding tenon (33) so that the latter (33) penetrates into the second end of the spring (20). The cup is then put in place by passing the free end of the stem through the central opening (52). The cup is brought closer to the valve body until the annular edge surface (152) contacts the inner face (54) of the cup. In this position, the valve seal (40) bears sealingly against the tapered edge (111). All that remains is to weld the cup and the valve body to each other at the annular edge surface (152). This weld can be made by any suitable means, and in particular by ultrasonic welding or by spin welding.

In the example presented here, as illustrated on FIG. 2, the cup is substantially planar at the location of the valve body and around the valve body. The height of the internal face of the fixing crown is substantially identical to the thickness of the valve seal (40). The tapered edge (111) helps to press the seal in a sealed manner against the inner face of the cup. Sealing between the cup (50) and the valve body (10) is therefore ensured by the valve seal being squeezed against the inner face (54) of the cup by the tapered edge (111), forming an annular seal all around the central opening (52). The weld at the interface between the fixing crown and the cup therefore does not need to be sealed. It must only hold the valve body against the cup against the effect of the spring (20) and ensure that the valve seal (40) is properly pressed against the inner face (54) of the cup. It therefore would be possible for the weld not to be continuous.

It would also be possible for the cup not to be flat, and in particular, for the central opening (52) to be on a bottom wall of a well (55) in which at least a portion of the crown (32) of the stem penetrates.

Figure 5:
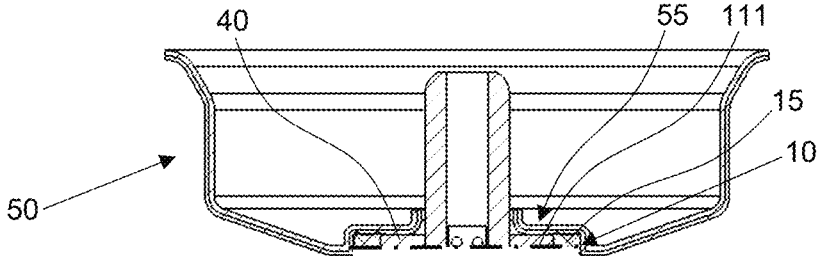
FIG. 5: a cross-sectional view of a first variant of the valve, in which an upper portion of the valve body (10) with a tapered edge (111) and a fixing crown (15) penetrate in a well (55) of the cup (50).

In a first variant embodiment, as illustrated on FIG. 5, the upper portion of the valve body with the tapered edge (111) and the fixing crown (15) also penetrates in the well (55). Welding between the valve body (10) and the cup is performed at the bottom wall of the well (55). The fixing crown (15) remains at the top of the tubular body, as in the present example, and it is dimensioned to penetrate into the well (55). It could also be envisaged to weld the cylindrical side walls of the valve body and of the well.

In a second variant embodiment, the weld is made at a peripheral section of the cup which surrounds the well (55). In this case, only the upper portion of the tubular body (11) with the tapered edge (111) penetrates in the well (55), whereas the fixing crown, which is wider than the well (55), is placed lower than the tapered edge.

In a third variant embodiment, the valve seal (40) is fixed to the bottom wall of the well, for example by overmolding. In this case, it is no longer necessary for a tapered edge of the valve body to keep it pressed against the inner face of the cup. The valve body does not penetrate in the well. The well plays the role of the upper portion of the valve body and the valve body itself can be shorter. The fixing crown, which is wider than the well, remains at the top of the valve body. As in the second variant, the weld is made at a peripheral section of the cup which surrounds the well. Welding of the valve body can then be carried out in a sealed manner. If the weld is not sealed, it is also possible to keep a tapered edge, as in the example presented here, and to interpose a second seal between the peripheral section and the tapered edge.

The cup can be reinforced so that it better withstands the pressure within the aerosol dispenser. In the present example, insofar the outer layer (53) is metallic, it can be sufficient to give a concave shape to the outer face (53) of the cup, and a convex shape to the inner face (54). Such a measure can prove to be insufficient, in particular when the cup is made exclusively of plastic material. In this case, vertical and radial reinforcing ribs can be provided on at least one of the faces of the cup, in particular on the outer face (53). When the cup includes a well, it is possible to place reinforcing ribs much higher and more effective than when the cup is simply domed as in the present example.

The valve body and the cup must be compatible to allow the valve body to be welded to the cup. For example, polypropylene, or other polyolefins, can be chosen for the valve body and for the cup or the plastic material layer of the cup. The valve body and the cup are not necessarily made in the same plastic material.

The advantage of the valve according to the invention lies in the fact that no part can be ejected from the valve. Indeed, all the parts are located on the side of the inner face of the cup and none is dimensioned to pass through the central opening. The weld between the valve body and the cup is not subjected to any tensile force. It therefore does not need to be particularly resistant.

LIST OF REFERENCES

1 Valve according to the invention
- 10 Valve body
- 11 Tubular body
  - 111 Tapered edge
  - 112 Passage opening
- 12 Bottom wall
  - 121 Inlet opening
- 13 Internal chamber
  - 131 Vertical ribs
- 14 Tenon
- 15 Fixing crown
  - 151 Transverse wall
  - 152 Annular edge surface of the fixing crown
  - **152*a*** Extra thickness for welding
  - **152*b*** Extra thickness for welding

20 Spring
30 Stem
- 31 Cylindrical wall
  - 311 Lower end
  - 312 Orifices
- 32 Crown
  - 321 Sealing rib
- 33 Spring guiding tenon

40 Valve seal
50 Cup
- 51 Peripheral edge
- 52 Central opening
  - 521 Reinforcing edge
- 53 Metallic outer layer
- 54 Inner layer in plastic material
- 55 Well A Main axis

The invention claimed is:

1. A valve for pressurized container, comprising:

a valve body in which are placed:
- a spring,
- a valve member, and
- a valve seal, as well as a cup having an outer face and an inner face and being provided with:
- a cylindrical well, and
- a central opening through which a product outlet rod can pass, the central opening of the cup being provided in a bottom wall of the cylindrical well, the valve body being fixed to the inner face of the cup by welding, wherein the valve seal is placed against the bottom wall of the cylindrical well and pressed against the cup while surrounding the central opening, wherein the valve body comprises a tubular body provided with a fixing crown by which the valve body is welded to the cup, and an annular protrusion surrounding the central opening and forming an annular tapered edge bearing sealingly against the valve seal and pressing the valve seal against the cup in a sealed manner, wherein the fixing crown penetrates in the cylindrical well, the welding being made between the fixing crown introduced into the well and the bottom wall of the well.

2. The valve according to claim 1, wherein the inner face of the cup is made of a plastic material, and the valve body is also made of a plastic material.

3. The valve according to claim 2, wherein the inner face of the cup is made of polypropylene or another polyolefin, and the valve body is also made of polypropylene or another polyolefin.

4. The valve according to claim 2, wherein the cup comprises at least a metallic outer layer and an inner layer in plastic material.

5. The valve according to claim 1, wherein the cup comprises at least a metallic outer layer and an inner layer in plastic material.

6. The valve according to claim 5, wherein the metallic outer layer is in aluminum or tin, and the inner layer is in polypropylene or another polyolefin.

7. The valve according to claim 1, wherein the valve body is welded to the cup by a discontinuous weld.

8. A method for manufacturing the valve according to claim 1, comprising:

placing the spring in a bottom of the valve body;

mounting the valve seal on a rod of a valve member to form a valve member/seal assembly;

inserting the valve member/seal assembly into the valve body so that a lower end of the valve member bears against the spring;

then bringing the cup and the valve body toward each other until the valve body is in contact with the inner face of the cup;

welding the cup and the valve body.

9. The method of claim 8, wherein the valve is a male valve, and during positioning of the cup on the valve, a free end of the rod of the valve member is passed through the central opening of the cup before bringing the cup and the valve body toward each other.

10. The method of claim 8, wherein the cup and the valve body are welded by ultrasonic welding or by spin welding.

11. The valve according to claim 1, wherein an edge of the central opening is folded upright.

12. The valve according to claim 11, wherein the edge of the central opening is folded upright on a side of the outer face.

13. The valve according to claim 1, wherein a peripheral edge of the cup forms a flat ring.

* * * * *